United States Patent [19]

Vogelzang et al.

[11] Patent Number: 4,936,323

[45] Date of Patent: Jun. 26, 1990

[54] HAIR CURLERS

[76] Inventors: John H. Vogelzang, 23 Longford Crescent, Scarborough, Ontario, Canada, M1W 1P3; Orazio L. Costa, 155 Woodyvine Way, North York, Ontario, Canada, M2J 4H7

[21] Appl. No.: 269,024

[22] Filed: Nov. 9, 1988

[51] Int. Cl.[5] ..... A45D 2/32

[52] U.S. Cl. ..... 132/239; 132/237; 132/242; 132/268

[58] Field of Search ..... 132/226, 237, 238, 239, 132/242, 264, 268, 245, 251

[56] References Cited

U.S. PATENT DOCUMENTS

| | | | |
|---|---|---|---|
| 2,167,446 | 7/1939 | Coggans | 132/242 |
| 2,682,878 | 7/1954 | Pisciotta | 132/242 |
| 2,763,270 | 9/1956 | Carey | 132/239 |
| 3,456,645 | 12/1948 | Norin et al. | 132/242 |
| 3,470,888 | 10/1969 | Kuhn | 132/237 |
| 4,335,168 | 6/1982 | Ergaver | 132/226 |

FOREIGN PATENT DOCUMENTS

| | | | |
|---|---|---|---|
| 607067 | 12/1934 | Fed. Rep. of Germany | 132/242 |
| 3633697 | 4/1988 | Fed. Rep. of Germany | 132/242 |
| 364325 | 10/1962 | Switzerland | 132/242 |

*Primary Examiner*—Gene Mancene
*Assistant Examiner*—Michael Lynch
*Attorney, Agent, or Firm*—Kenneth M. Garrett

[57] ABSTRACT

A hair curler comprising a roller and a support therefor. The support includes jaws which permit the roller to slide therealong between an entrance position in which the roller is freely rotatable and a grasping position which permits final adjustment of hair tension on the roller. The support includes a comb, and hair tension locks the comb in position on the scalp.

11 Claims, 1 Drawing Sheet

FIG. 1.
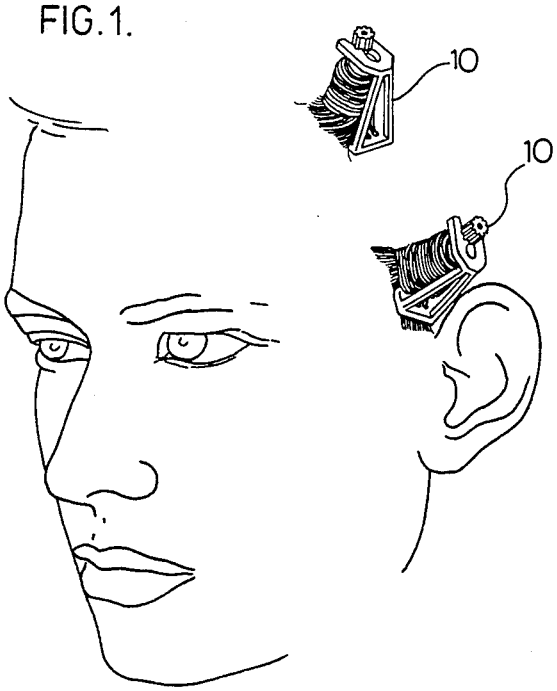
FIG. 3.
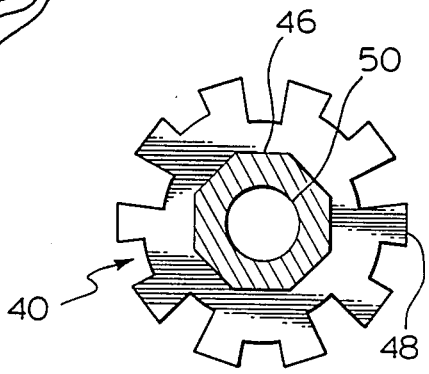
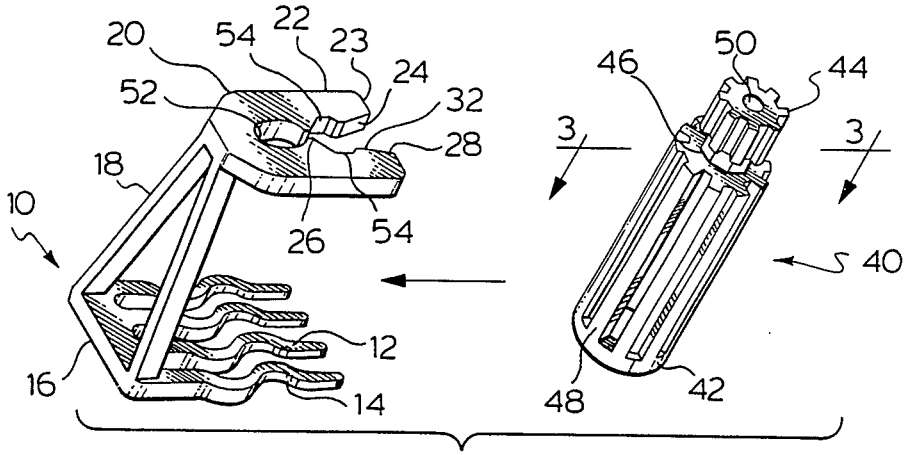
FIG. 2.

HAIR CURLERS

FIELD OF INVENTION

This invention relates to new and useful improvements in hair curlers. It particularly relates to hair curlers that are supported upon a base.

BACKGROUND OF INVENTION

Generally speaking hair curlers of the foregoing type include a hollow hair roller, and an axle supported from the base upon which the roller is mounted for rotation. This arrangement generally necessitates the roller being mounted on the axle prior to the hair being rolled thereon, and the roller is suspended from the mesh of hair curled around it, rather than being held in a positive location on the scalp.

In accordance with U.S. Pat. No. 2,682,878 to Pisciotta, a base is provided with a positive gripping function. The roller is demountable from the base, and may be mounted thereon subsequent to rolling the hair. However, mounting of the roller onto the base locks the roller, whereby final adjustment of the hair tension on the roller is not possible.

SUMMARY OF THE INVENTION

In accordance with a broad aspect of the invention a hair curler comprises a base which may suitably be in the form of a comb, and jaws supported from the comb.

A hair roller includes a generally cylndrical body portion, a head portion forming a handle therefor, and a neck portion connecting the head portion to the body portion, the portions being coaxial. The jaws opening is shaped at the entrance thereto to permit the neck portion of the roller to slide freely therealong, and also to rotate freely about the cylindrical axis thereof. The neck portion and the jaws opening at the end thereof are provided with cooperating ratchet elements to provide a restricted angular movement of the hair roller about its axis. Desirably the ratchet elements are unitarily formed on the neck portion and the jaws.

The arrangement permits hair to be freely rolled on the roller when it is wholly disconnected from the base, and also when it is supported by the jaws when positioned at the entrance thereto. As the roller is urged into the end of the jaws opening, it may no longer rotate freely, but final adjustments to the hair tension may readily be made by applying a torquing force to the handle portion of the roller to overcome the resistance of the ratchet.

In accordance with the preferred embodiment the neck portion of the roller has a polygonal cross section and the end of the jaws opening is defined by wall structure including at least one facetted portion that will periodically interefere with the neck portion as it rotates, to provide the ratcheting action.

Suitably the neck portion has a circumscribing diameter marginally greater than the inscribed diameter of the jaws opening on approach to the end thereof so that the roller snaps into the jaws at the end of the jaws opening.

Preferably the jaws are constructed so as to resiliently deform as the roller snap fits into the end of the jaws opening, and as the roller is rotated in this position by application of a torquing force.

These foregoing objects and aspects of the invention, together with other objects, aspects and advantages thereof will be more apparent from the following description of a preferred embodiment thereof, taken in conjunction with the following drawings.

IN THE DRAWINGS

FIG. 1—shows in perspective view a plurality of hair curlers constructed in accordance with the invention in their manner of use;

FIG. 2—shows in perspective view the component parts of the hair curler in a disengaged position, and FIG. 3—is a cross section along the line 3—3 of FIG. 2.

DESCRIPTION OF PREFERRED EMBODIMENTS

Referring to the drawings in detail, a hair curler constructed in accordance with the invention is identified generally therein by the numeral 10. Hair curler 10 comprises a comb 12 having teeth 14, a back 16, and rods 18 upstanding from back 16 supporting jaws 20, which generally overlie comb 12 in parallel spaced apart relation therewith. Teeth 14 are sinuously formed in the plane of back 16 for a purpose to be described.

Jaws 20 are formed by a flange 22 having a free edge 23 and a slotted opening 24 in communication therewith. Slotted opening 24 has a blind end portion 26, an entrance portion 28 and an intermediate portion 32 at the juncture of the entrance portion and blind end portion. Slotted opening 24 has an axis in general alignment with teeth 14.

Hair curler 10 further comprises a hair roller 40 comprising a body portion 42, and at one axial end that of a head portion 44 and a neck portion 46, the portions being in coaxial alignment. Hair roller 40 is generally in the form of a hollow cylinder formed by a plurality of elongated axially aligned, radially spaced fingers 48, and an axial opening 50 to the interior thereof in head portion 44. Neck portion 46 has a regular octagonal cross section, as best seen in FIG. 3.

The entrance portion 28 to the jaws opening 24 has an inscribed diameter somewhat greater than the circumcircular diameter of neck portion 46 of hair roller 40, to permit the neck portion to engage in the jaws opening and rotate freely about the cylindrical axis of the hair roller, and to slide freely along the jaws opening towards the blind end portion 26 thereof. The inscribed diameter of jaws opening 24 at intermediate portion 32 thereof is marginally less than the circumcircular diameter of neck portion 46, to form a restriction to the engagement of hair roller 40 in blind end portion 26 of opening of jaws 20. Under an urging force applied manually through hair roller 40, jaws 20 will resiliently deform to permit the hair roller to snap into blind end portion 26. This resilient deformation is facilitated by providing an enlarged slit 52 rearwardly of blind end portion 26 in communication therewith. Blind end portion 26 of jaws opening 24 is facetted at diametrically opposed portion 54 that engage facets of polygonal neck portion 46 when aligned therewith, or which interfere with the neck portion when the facets are non-aligned, which interference will arise periodically when hair roller 40 is rotated when engaged in the blind end portion 26 of jaws opening 24.

In using hair curler 10, hair strands will normally be rolled onto body portion 42 with roller 40 initially disengaged from jaws 20. Comb 12 will be positioned relative to the roller 40 and engaged with the hair, following which the neck portion 46 of the roller will be engaged in the entrance portion 28 of the jaws opening, at which time further tension may be applied to the hair by freely rotating the roller. Roller 40 will then be urged into position in the blind end portion 26 of the jaws opening, where it will be restrained from rotating, absent a torque force applied to the roller, conveniently through head portion 44, thereby permitting final tension adjustment to be made. The application of a final tensioning force to the hair through roller 40 will serve to lock comb 12 firmly into position on the scalp of a user by trapping tensioned hair strands between back 16 and the sinuous formations of teeth 14.

The hollow open structure of hair roller 40 facilitates the flow of treating solution to the hair, which may be applied through opening 50 in head portion 44, and also facilitates the drying of the hair.

It will be apparent that many changes may be made to the illustrative embodiment, while falling within the scope of the invention and it is intended that all such changes be covered by the claims appended hereto.

We claim:

1. Hair curler comprising:

a comb and jaws;

wall means supporting said jaws from said comb in a plane parallel to the plane of said comb in fixed spaced apart relation therewith;

a hair roller comprising a generally cylindrical body portion, a head portion and a neck portion connecting said body portion to said head portion, said portions being coaxial;

said jaws having a blind ended opening thereto;

said jaws being configured to permit the sliding engagement of said neck portion therealong to a first position in which said roller is supported therefrom and is freely rotatable about its cylindrical axis and a second position adjacent said blind end, and said neck portion and said blind end portion being provided with cooperating ratchet elements to provide a restricted angular movement of said hair roller about its cylindrical axis when in said second position.

2. Hair curler as defined in claim 1, wherein said neck portion has a polygonal cross section and said blind end is defined by wall structure including at least one faceted portion that periodically interferes with said neck portion as said roller is angularly displaced to provide said ratchet elements.

3. Hair curler as defined in claim 2, wherein said jaws are configured therealong to snap retain said roller in said second position.

4. Hair curler as defined in claim 3, wherein said jaws resiliently deform as said roller is rotated when said neck portion is engaged in said blind end.

5. Hair curler as defined in claim 1, wherein said ratchet elements are unitarily formed with said jaws and said hair roller.

6. Hair curler as defined in claim 1, wherein said jaws opening is generally aligned with teeth of said comb.

7. Hair curler as defined in claim 6, wherein said comb includes a back and wherein said teeth are sinuously formed in the plane of said back.

8. Hair curler as defined in claim 7, wherein said hair roller is hollow and has openings in the body portion and head portion thereof communicating together.

9. Hair curler as defined in claim 8, wherein said body portion of said hair roller comprises a plurality of axially elongated radially spaced apart fingers laying on a cylindrical surface.

10. Hair curler as defined in claim 9, wherein said neck portion has an octagonal cross section.

11. Hair curler as defined in claim 10, wherein said jaws are slit rearwardly of said blind end to facilitate the resilient opening of said jaws.

* * * * *